US010326223B2

(12) United States Patent
Sorig et al.

(10) Patent No.: US 10,326,223 B2
(45) Date of Patent: Jun. 18, 2019

(54) ELECTRICAL PRESS-FIT CONTACT ELEMENT

(71) Applicant: Ludger Sorig, Aschenberg (DE)

(72) Inventors: Ludger Sorig, Aschenberg (DE); Hartwig Stein, Scheuring (DE)

(73) Assignee: LUDGER SORIG, Ascheberg (DE)

( * ) Notice: Subject to any disclaimer, the term of this patent is extended or adjusted under 35 U.S.C. 154(b) by 0 days.

(21) Appl. No.: 15/872,261

(22) Filed: Jan. 16, 2018

(65) Prior Publication Data

US 2018/0205163 A1 Jul. 19, 2018

(30) Foreign Application Priority Data

Jan. 16, 2017 (DE) ..... 10 2017 100 724

(51) Int. Cl.
*H01R 13/03* (2006.01)
*H01R 12/58* (2011.01)
*H01R 43/16* (2006.01)

(52) U.S. Cl.
CPC ..... *H01R 12/585* (2013.01); *H01R 13/03* (2013.01); *H01R 43/16* (2013.01)

(58) Field of Classification Search
CPC ..... H01R 12/585; H01R 43/16; H01R 13/03
See application file for complete search history.

(56) References Cited

U.S. PATENT DOCUMENTS 3,838,388 A * 9/1974 Bauerle ..... H01R 13/112 439/857
3,910,664 A * 10/1975 Pauza ..... H05K 7/1076 439/331
4,017,143 A 4/1977 Knowles
4,080,037 A * 3/1978 Kunkle ..... H01R 13/113 439/853
4,752,250 A * 6/1988 Seidler ..... H01R 12/585 29/882
4,802,862 A * 2/1989 Seidler ..... H01R 12/585 439/83

(Continued)

FOREIGN PATENT DOCUMENTS

CA 2056713 A1 5/1992
DE 9016257 U1 4/1991

(Continued)

*Primary Examiner* — Truc T Nguyen
(74) *Attorney, Agent, or Firm* — Lucas & Mercanti, LLP; Klaus P. Stoffel

(57) ABSTRACT

An electrical press-in contact element with at least one press-in section, which extends in a direction of extension from a root area, in which the press-in section is connected with a contact body, up to a free end, and which has a middle zone flanked on either side by a respective edge zone from the root area up to the free end, wherein the edge zones form contact surfaces facing away from each other that, once the press-in section has been inserted into a press-in opening, for example of a circuit board, abut against the wall of the press-in opening. In order to improve the stability and contact reliability, it is provided that the edge zones are bent away from the middle zone around a bending line, so that the press-in section has a U- or C-shaped cross section. The edge zones form webs that project from the middle zone.

18 Claims, 5 Drawing Sheets

(56) References Cited

U.S. PATENT DOCUMENTS

| | | | | |
|---|---|---|---|---|
| 4,854,900 | A * | 8/1989 | Muhlhoff | H01R 12/585 439/751 |
| 5,224,880 | A * | 7/1993 | Schempp | H01R 12/585 439/682 |
| 6,132,225 | A | 10/2000 | Murr et al. | |
| 2008/0188100 | A1 | 8/2008 | Saitoh | |
| 2009/0116185 | A1 | 5/2009 | Su | |
| 2013/0244506 | A1* | 9/2013 | Endo | H01R 4/48 439/825 |
| 2013/0244512 | A1* | 9/2013 | Endo | H01R 12/585 439/889 |
| 2015/0079851 | A1* | 3/2015 | Endo | H01R 12/585 439/736 |
| 2015/0118871 | A1* | 4/2015 | Yagi | H01R 12/523 439/65 |
| 2017/0310027 | A1* | 10/2017 | Goto | H01R 12/585 |

FOREIGN PATENT DOCUMENTS

| | | | |
|---|---|---|---|
| DE | 3831508 | C2 | 2/1997 |
| DE | 19831672 | A1 | 2/2000 |
| DE | 112006000095 | T5 | 4/2008 |
| DE | 202009009933 | U1 | 10/2009 |
| DE | 102012224225 | A1 | 6/2014 |
| DE | 102014107438 | A1 | 12/2015 |
| DE | 102015200491 | A1 | 7/2016 |
| DE | 202016102148 | U1 | 7/2017 |
| EP | 0313300 | A1 | 4/1989 |

* cited by examiner

ELECTRICAL PRESS-FIT CONTACT ELEMENT

CROSS-REFERENCE TO RELATED APPLICATIONS

The present application claims priority of DE 10 2017 100 724.5, filed Jan. 16, 2017, the priority of this application is hereby claimed and this application is incorporated herein by reference.

BACKGROUND OF THE INVENTION

The invention relates to an electrical press-in contact element with at least one press-in section, which extends in a direction of extension from a root area, in which the press-in section is connected with a contact body, up to a free end, and which has a middle zone flanked on either side by a respective edge zone from the root area up to the free end, wherein the edge zones form contact surfaces facing away from each other that, once the press-in section has been inserted into a press-in opening, for example of a circuit board, abut against the wall of the press-in opening.

A press-in contact element is previously known from DE 198 31 672 B4. The press-in contact element disclosed therein has a press-in section, which is connected with a contact body. The contact body has a contact element. The press-in section is pin-shaped, and can be made to abut in a conductively connecting, resiliently biased manner against the inner wall of a hole in a circuit board that forms a press-in opening. The force for pushing the press-in section into the through connected hole of the circuit board is applied by impinging upon a push-in shoulder formed by the contact body. The bulbous or inclined shape of the contact used in prior art has here proven advantageous for achieving the lowest possible press-in forces up until reaching its largest envelope circle diameter. Such press-in contacts are used for manufacturing solderless connections according to DIN EN 60352-5, and designed in the longitudinal direction starting from the press-in end with an integrally connected plug end, connection area or pressed screen.

In order not to damage the circuit board and its through-hole plating, and in particular its inner conductor paths, in the pressing in process, it makes sense that the press-in section be resilient in design, and press against the hole wall with a relatively slight force. To achieve this, the goal is to have a relatively slight normal force for the legs of the press-in sections abutting against the hole wall. However, the force required to push the press-in sections out of the circuit board perforations must be relatively high for reasons of stability, in particular given freestanding contacts. Important in terms of quality, this requirement cannot be satisfied given slight material thicknesses for the press-in contact formed by the press-in sections, however, in particular if the normal force of the legs of the press-in contacts is low. A slight push-out force or even retention force is also disadvantageous during vibration loads that arise in automotive applications in the engine compartment, since the contacts can become loosened, which increases the contact resistance. This type of damage can result in the complete failure of the electrical connection.

Such press-in contacts are often integrally connected with continuing areas. The latter can be designed as socket contacts for round or flat plugs, crimped connections, insulation-displacement connections, foil connections or pressed screens, etc. Such applications require elastic, resilient properties to enable a flawless contacting with the mating plug or connecting piece. For this reason, the material thickness is often slight, for example 0.3 mm. However, this thickness is occasionally insufficient for satisfying the above requirements placed on such press-in contacts. In particular, the slight material cross sections and relatively small contact surface in the circuit board perforation often make it impossible to achieve the desired high current carrying capacity as well as the desired cold welding. For this reason, such components are manufactured out of step-milled strip material in prior art. This means that the strip with an exemplary thickness of 0.8 mm for the press-in zone area must be reduced to 0.3 mm in the area of the adjoining contact regions. Since this process usually takes place via milling, such strips are expensive. Press-in contacts like these fabricated out of a blank strip are usually provided with a galvanic surface in an additional step. The latter consists of pure tin due to the required cold welding with the through-hole plating of the circuit board and the unleaded regulation. However, surfaces galvanically plated with pure tin are known to be susceptible to whisker formation when exposed to the pressure and bending load that arises in a press-in connection. These whiskers are undesirable, and can cause short circuits during application. In addition, the continuing areas are often made out of pre-coated strip for costs reasons, and thus have blank cutting edges. The latter can be disadvantageous when used as a contact surface in press-in contacts in the through-hole plating of the circuit board. Therefore, these press-in areas are galvanically coated in a separate operation in prior art. This additional operation is very cost-intensive and complicated.

Prior art further includes DE 38 31 508 C2 and U.S. Pat. No. 4,017,143, which each show an electric press-in contact element, in which a cross sectional profile is imparted to the press-in section via embossing with a die stamp.

U.S. Pat. No. 6,132,225 discloses a press-in section that is curved over its entire direction of extension around a single bending line, thereby forming edge zones that project from the original extension plane of the sheet metal blank.

DE 10 2014 107 438 A1 discloses a slotted press-in section with an impressed recess.

DE 20 2009 009 933 U1 discloses a slotted press-in section with bilateral impressions, so that webs form in a contact area.

DE 20 2016 102 148 U1 discloses a press-in section consisting of two parallel legs.

EP 0 313 300 A1 discloses a press-in section, wherein a groove with a V-shaped cross section is impressed into its contact area.

DE 90 16 257 U1 and DE 10 2015 200 491 A1 disclosed press-in sections with troughs impressed into the contact area.

DE 11 2006 000 095 T5 discloses a press-in section with legs that are separated by a free space and can be resiliently moved toward each other.

SUMMARY OF THE INVENTION

The object of the invention is to further develop the electric contact element mentioned at the outset in a manner advantageous for its use, and in particular to change the resilient area of the press-in section in such a way that the normal force of the two legs of the press-in section is relatively low, and in particular that a bulbous or inclined area of the press-in section is retained until the largest envelope circle diameter of the contact has been reached.

It is initially and essentially provided that the edge zone be bent away from the middle zone. It can further be provided that the press-in section have a U- or C-shaped cross section. An S-shaped or Z-shaped cross section is also possible. In a cross sectional plane through the extension direction of the press-in section, this yields a curved material strip, whose edge is formed by the edge zones, and whose middle section is formed by the middle zone. The press-in section preferably has this kind of a curved shape over its entire length. The press-in contact element has a press-in section formed by a flat piece, whose edge zones are bent away from the middle zone around a respective bending line. According to the invention, the U- or C- or Z-cross sectional profile is generated through bending around a bending line, wherein the narrow corners of the flat piece face in the direction of the broad side of the flat piece after bending, and the contact surfaces are formed by the edge sections of the broad side surfaces of the flat piece. The middle section can extend along a straight line, which, provided the press-in section has a U-shaped cross section, can comprise the U-leg. The two edge zones then form the two U-legs. Given an S-shaped or Z-shaped cross section, the two edge zones face in directions facing away from each other. The edge zones preferably form webs that project from the middle zone. A channel can extend between the edge zones, whose floor is the middle zone. This channel preferably runs over the entire extension length of the press-in section, i.e., from the root area toward the free end. The press-in section is preferably an integral constituent of a stamped and bent part, out of which the press-in contact element is fabricated. After formed, the stamped and bent part comprises a contact body having contact elements with a wide variety of shapes, for example for inserting a plug or clamping a cable. The press-in contact element can have several press-in sections extending parallel to each other. Each press-in section preferably forms an outer surface and an inner surface lying opposite it. The outer surface and inner surface are formed by the two opposing broad side surfaces of the sheet metal part out of which the press-in contact element is made. The edge zones are bent away from the extension plane of the sheet metal. In particular, they are bent away from the outer surface, so that, in a preferred embodiment, the outer surface of the press-in section has a rounded section, which in particular joins an outer surface section of the middle zone with the contact surface formed by an outer surface section of the edge zone. An inner surface of the press-in section can have a section allocated to the middle zone, and a section running essentially perpendicularly thereto. The section of the inner surface allocated to the middle zone is preferably flanked on either side by sections of the inner surface of the edge zone standing perpendicular on the section of the middle zone. The two sections of the inner surface running parallel to each other adjoin each other on bending lines. A further development of the invention provides that an outline contour line of the press-in section run arced in a connection area, wherein the connection area extends from a first narrow region of the press-in section to a root area. The connection area is adjoined by a contact area, which incorporates the contact surfaces that come into electrical contact with the through-hole plated press-in openings. The layout of the press-in section has a bulbous shape in the contact area. Proceeding from the first narrow area, the outline contour lines extend on an arc line, wherein the two arc lines are directed away from each other, thereby yielding a region that has the largest diameter between two narrow areas of the press-in section and accommodates the contact surfaces. Preferably arranged in the contact area extending between the connection area and end area is a slot, an impression and/or a curvature. The impression can have rounded outer edges and be arranged in the area of the slot, wherein the impression in particular is formed on the inner surface. The outer surface lying opposite the inner surface preferably has a curvature that lies opposite the impression. If the contact body has a hollow form and several press-in sections extending from the edge of the hollow form zones are provided, it is provided in particular that the webs formed by the edge zones be outwardly directed, while the curvatures of the outer surface lying opposite the webs face inwardly, meaning in the direction of the cavity of the hollow form. The configuration according to the invention imparts an elevated stability to the press-in section of a generic press-in contact element. A slot extending in the middle zone is flanked on either side by the contact surfaces. The slot divides the press-in section into two contact legs, which can resiliently deform toward each other. According to the invention, the normal force of the contact legs of the press-in contact is relatively slight. The bulbous or inclined region of the contact surface or the outer surface formed by the edge zone is retained until the largest envelope circle diameter of the contact is reached, which causes slight press-in forces. However, the push-out forces that arise while pushing out the press-in contact or the retention forces remain relatively high. The material thickness of the press-in section integrally joined with the contact body is the same. However, the stability of the press-in section has increased due to the outwardly bent edge zone. In addition, the contact surface has also become larger. As a consequence, there is a relatively high current carrying capacity. The through-hole plating of a circuit board is not damaged while inserting the press-in section. The contact resistance is low as well. The entire component is preferably integrally fabricated out of a strip of the same thickness with a uniform pre-coating. The strip has a pre-coated surface. While a galvanic coating is possible, it is preferably not required. The surface can also be galvanically pre-coated with silver or a silver-tin alloy, gold or some other suitable metal. The coating can also be applied after the fact.

It is further advantageous if the contact body and press-in section, i.e., in particular the entire press-in contact element, are made out of a pre-coated metal strip. The manufacturing steps essentially involve stamping and bending. Outwardly curved press-in sections having contact legs are formed in the process. The contact legs are separated from the slot, and then preferably are each L-shaped. The outwardly curved contact legs have upwardly bent webs along the outer contour from a bending technology standpoint, which serve as contact surfaces and for stabilization purposes, and are pressure-deformed on one side to produce a recess that resembles a calotte, the outer radius of which is smaller than the outer radius of the bulbous form of the press-in contact. They alter the bending radius of the raised webs in the area of the bulbous form in such a way as to yield a contour that elevates the retaining force of the press-in contact in the through-hole plating and simultaneously forms a larger current carrying surface in the contacting area for improved power transmission. In order to make the normal force of the press-in zone adjustable, the calotte generated in particular through embossing is centrally provided with the mentioned slot. The width or length of this slot produces a change in the material cross section, and thus makes the normal force adjustable. This is important in particular when the press-in section is inserted as a direct plug for circuit board perforations in order to stabilize the area between the press-in section and a contact element formed by the contact body. In a preferred embodiment, the contact body has a reinforcing bead in the root area, which is preferably inwardly curved if the contact body is a hollow body. The contact elements can be made out of a copper alloy. Possible as the contact element is a socket contact, an insulation-displacement connection, a foil connection or a crimped connection. The socket contact can have a free punch. Also provided is a positioning stop, which presses against the surface of the circuit board while pressing in the press-in contact element. The socket contact can have a plurality of bent contact lamellae. An insertion slot for a plug is formed between the contact lamellae. The contact lamellae can be provided with radius-shaped contact points, the frontal elongation of which has an additional radius for abutting against the socket wall, which is formed in particular by the inner wall of the contact body designed as a hollow body.

The channel extending over the entire length of the press-in section is bounded by the two webs. The two webs essentially form flat inner channel walls, which accompanied by the formation of a crease or bending line transition into a flat channel, which is formed by the middle zone. The two webs have a constant height over their entire length of extension. The outer walls of the webs form the contact surfaces in the contact area, and at least regionally run on planes that transition into an opposing outer wall in the floor of the channel with the formation of curves. The contour line of the webs runs in the plane of the middle zone along arc lines, which are spaced maximally apart from each other in the central area of the press-in section.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
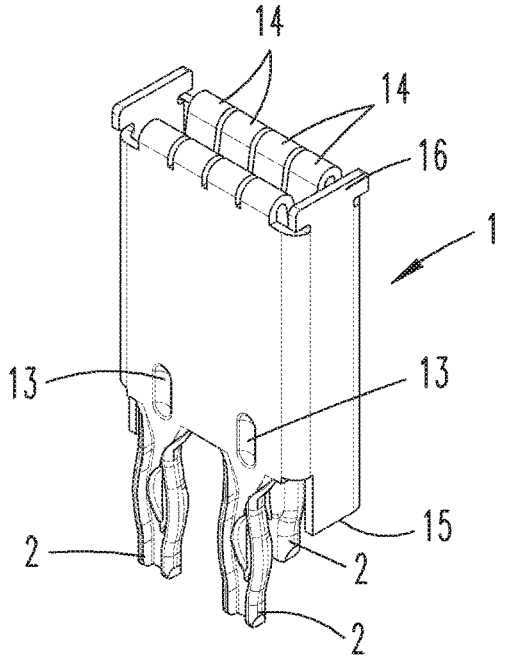
FIG. 1 is a first perspective view of a press-in contact element with a box-shaped contact body and three press-in sections.
Figure 2:
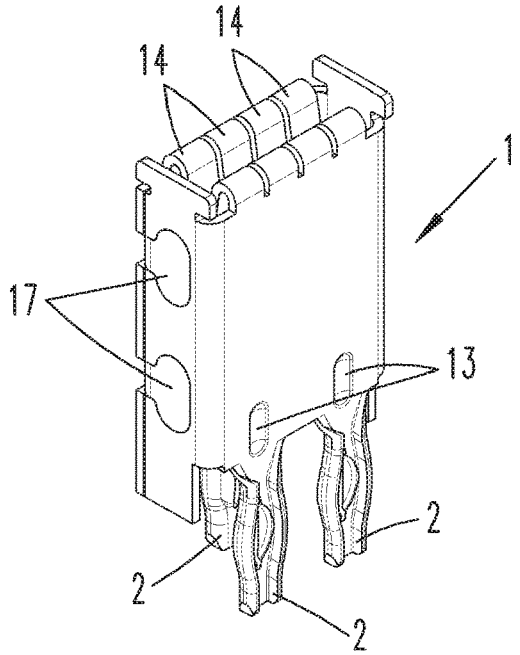
FIG. 2 is a second perspective view of the exemplary embodiment.
Figure 3:
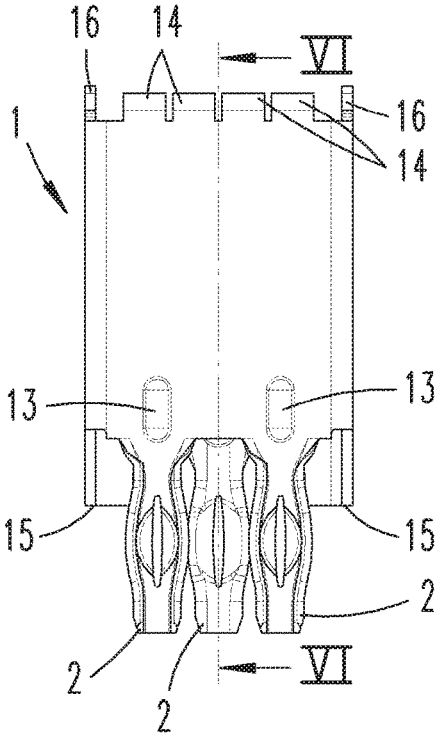
FIG. 3 is a side view of the exemplary embodiment.
Figure 4:
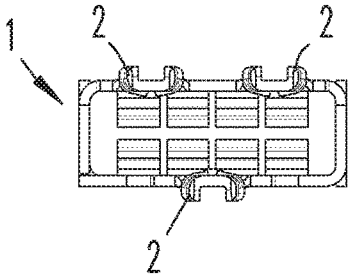
FIG. 4 is a bottom view of the exemplary embodiment.
Figure 5:
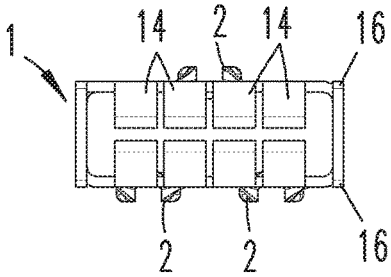
FIG. 5 is a top view of the exemplary embodiment.
Figure 6:
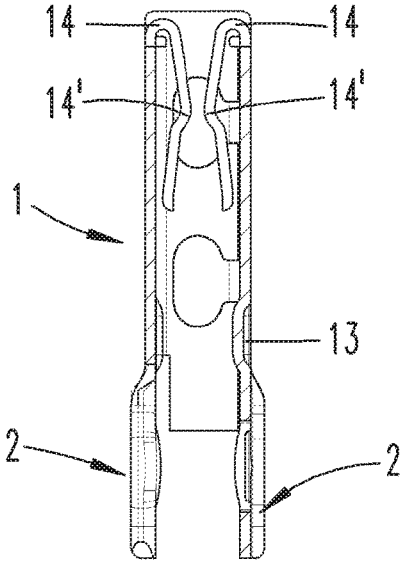
FIG. 6 is the section according to line VI-VI on FIG. 3.
Figure 7:
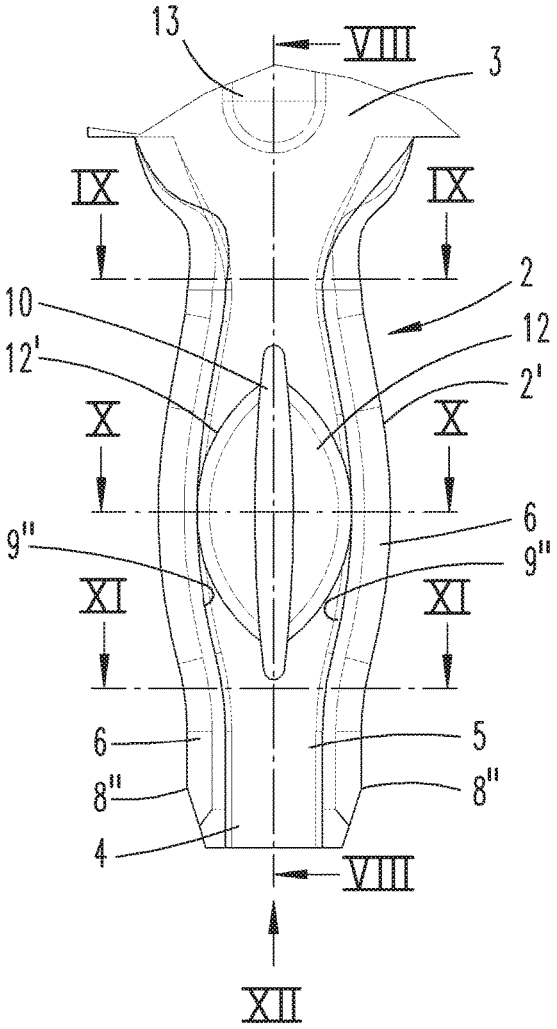
FIG. 7 is a magnified top view of the outwardly facing broad side of a press-in section.
Figure 8:
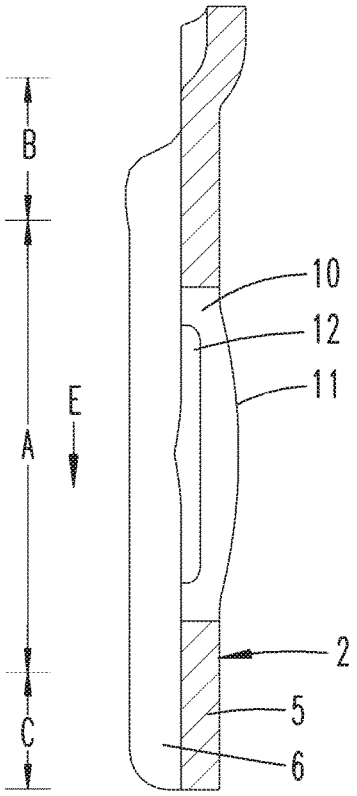
FIG. 8 is the section according to line VIII-VIII on FIG. 7.

The press-in contact elements shown on the drawings are fabricated out of a metal strip as the starting material. The metal strip can be a tin-plated metal strip. The metal strip preferably consists of a nonferrous metal, and in particular of a copper alloy. A stamped part is first fabricated out of the metal strip in a stamping process, which can then be galvanically coated. In a subsequent, in particular multistage bending process, the press-in contact element is given its final form, which is shown on the figures.

The press-in contact element has a contact body 1, which can be configured to reflect the application and have contact elements 14 of varying design, with which the contact body 1 can be brought into electrically conductive contact with a cable or some other electrically conductive material. The contact body 1 is integrally joined with at least one press-in section 2, which can be inserted into a through-hole plated press-in opening of a circuit board. In order to limit the insertion depth, the contact body 1 has a positioning stop 15, which rests on a broad side plane of the circuit board in the pressed in state.

The first exemplary embodiment shown on FIGS. 1 to 6 has a box-shaped contact body 1, which forms a hollow body. One contact side of the contact body 1 has a slot for inserting a plug. The contact elements 14 projecting from the slot edge form lamellae that extend into the cavity of the contact body 1. The contact elements 14 form inwardly bent contact lamellae, whose rounded contact points abut against a plug inserted into the socket contact. The contact lamellae continue on beyond the contact points, and there also form curves. A curve section can abut against the inner wall of the contact body 1. The contact body 1 consists of sheet metal molded into a box shape. The separating points have a clinched joint 17.

Figure 13:
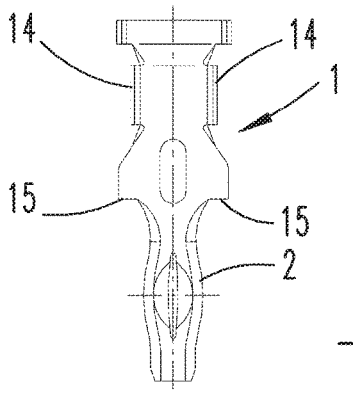
FIG. 13 is a top view of a second exemplary embodiment of the invention.
Figure 14:
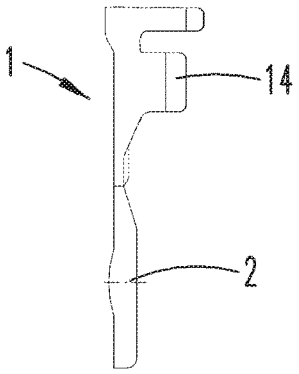
FIG. 14 is a side view of the second exemplary embodiment.
Figure 15:
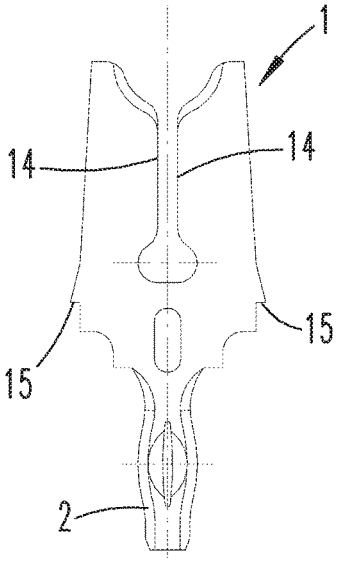
FIG. 15 is a top view of a third exemplary embodiment of the invention.
Figure 16:
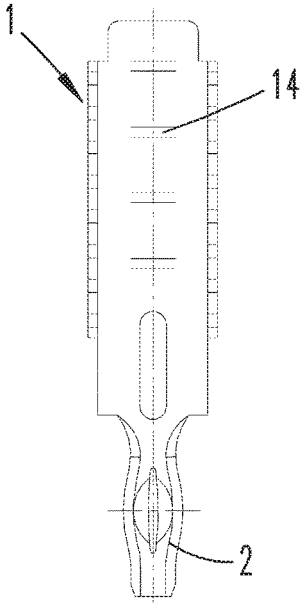
FIG. 16 is a top view of a fourth exemplary embodiment of the invention.
Figure 17:
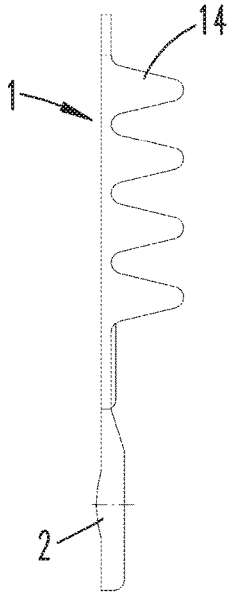
FIG. 17 is a side view of the fourth exemplary embodiment.

The exemplary embodiment for a press-in contact element shown on FIG. 13 has a contact element 14 in the form of a crimped connection. The exemplary embodiment shown on FIG. 15 has a contact element in the form of an insulation displacement connector, while the exemplary embodiment shown on FIG. 16, 17 has a contact element 14 in the form of a foil connection.

The press-in section 2 in the exemplary embodiments shown on FIG. 13 to 17 or the press-in sections 2 in the exemplary embodiment shown on FIGS. 1 to 6 is magnified on FIGS. 7 to 12, and will be described below.

The press-in section 2 extends in a direction of extension E from a root area 3, which lies in a connection area B, and in which the press-in section 2 is integrally joined with the contact body 1, via a contact area A and toward a free end 4, which comprises the end of an end area C. The press-in section 2 consists of a narrow metal strip, which over its entire length extending from the root area 3 to the free end 4 has a middle zone 5 that is flanked on either side by an edge zone 6. An outline contour line 2' of the press-in section 2 is thus formed by the two edge zones 6.

The two edge zones 6 form webs that are bent out of the extension plane of the middle zone 5 and impart a U-shape to the cross section of the press-in section 2. In the exemplary embodiments, the edge zones 6 are bent away in the same direction from the middle zone 5. However, it is also provided that the edge zones 6 are bent away from the middle zone 5 in differing directions, so that the webs project from the middle zone in directions facing away from each other. This type of press-in section can have an S-shaped or Z-shaped cross section.

In the root area 3, the webs formed by the edge zones 6 run at an inclination, passing over into the surface of the contact body 1. In the connection area B located there, the outline contour line 2' proceeds from a narrow area of the press-in section 2 and runs along an arc line, to end at an outer edge of the contact body 1. The narrow area in the transitional region between connection area B and contact area A roughly corresponds to the distance between the two contour lines 2' in the area of the free end 4.

In connection area A, the press-in section 2 has a bulbous contour. The outline contour lines 2' each run on an arc line, wherein the two arcs face away from each other, so that the press-in section 2 is widest in roughly the middle of the contact area A.

Figure 9:
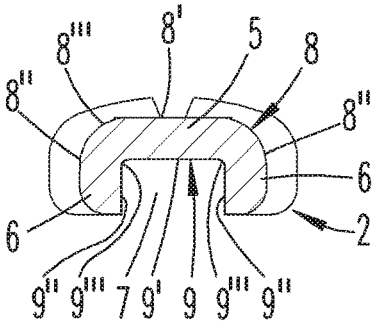
FIG. 9 is the section according to line IX-IX on FIG. 7.
Figure 10:
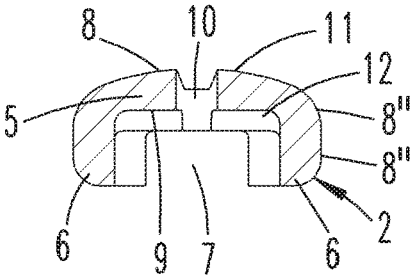
FIG. 10 is the section according to line X-X on FIG. 7.
Figure 11:
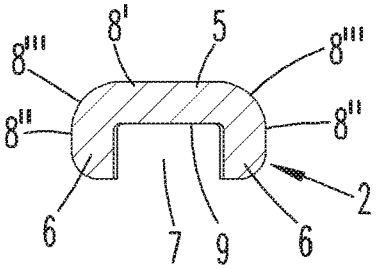
FIG. 11 is the section according to line XI-XI on FIG. 7.
Figure 12:
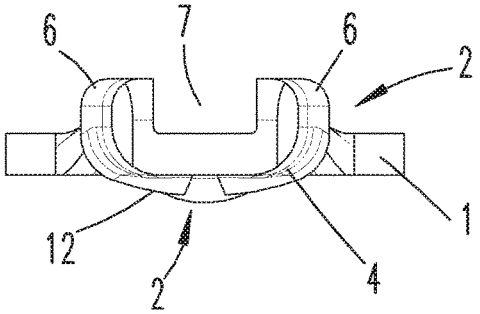
FIG. 12 is a top view of the free end 4 of the press-in section.

As evident from FIGS. 9 and 12, the cross sectional length of the middle zone 5 is roughly twice as long as the two edge zones 6 extending essentially at a right angle to the middle zone 5. An outer surface 8 of the press-in section 2 runs essentially flat in a section 8' of the middle zone 5, and forms a rounded section 8''' in the transitional region to the edge zone 6. The round section 8''' joins the essentially flat section 8' with an also rounded or only regionally flat section 8'', which forms a contact surface. The outer surface section 8'' comprising the contact surface is formed by the outer side of the middle zone 5, and in the pressed-in state abuts against the through-hole plated wall of the press-in opening of the circuit board in an electrically conductive manner.

The curve of the section 8'' can continue up to a section 9'' of an inner surface 9, which lies opposite the outer surface 8. The inner surface section 9'' essentially runs flat, and is allocated to the edge zone 6. With the formation of a bending line 9''', the inner surface section 9'' forms a right angle while passing over into a flat inner surface section 9', which runs parallel to the outer surface section 8'. This yields a channel 7 with channel walls 9'' and a channel floor 9'.

The bending line 9'' essentially follows the outline contour line 2'. It runs at the same distance from the outline contour line 2'.

In connection area B, meaning in the area where it is widest, the middle zone 5 has a slot 10 that extends in the first direction of extension E and there separates the press-in section 2 into two contact legs, which can be resiliently moved toward each other, wherein the width of the slot 10 diminishes. An impression 12 helps influence the elasticity of the contact legs, wherein it is designed like a calotte and has a rounded edge 12' that borders the bending line 9''' in a crown area.

The impression 12 is allocated to the inner surface 9. The area of the outer surface 8 lying opposite the impression 12 has a curvature 11.

Additionally provided in the area of the root 3 is a reinforcing bead 13, which extends until into the root area 3, and sits roughly in the axial center of the press-in section 2.

The above statements serve to explain the inventions encompassed as a whole by the application, which further develop the prior art at least by the following feature combinations, but also taken separately, specifically:

An electric press-in contact element, characterized in that the edge zones 6 are bent away from the middle zone 5 around a bending line.

An electric press-in contact element, characterized in that the press-in section 2 has a U- or C-shaped cross section.

An electric press-in contact element, characterized in that the edge zones 6 form webs projecting from the middle zone 5.

An electric press-in contact element, characterized in that an outer surface 8 of the press-in section 2 has a rounded section 8''', which in particular joins an outer surface section 8' of the middle zone 5 with the contact surface 8''.

An electric press-in contact element, characterized in that an inner surface 9 of the press-in section 2 has a section 9' allocated to the middle zone 5 and sections 9'' running essentially perpendicularly thereto allocated to the edge zones 6, which are bent out of the extension plane of the middle zone 5, in particular with the formation of bending lines 9'''.

An electric press-in contact element, characterized in that an outline contour line 2' of the press-in section 2 lying in the extension plane of the middle zone 5 runs along an arc in a connection area B extending from a first narrow area up to the root area 3.

An electric press-in contact element, characterized in that, in a contact area A lying between the connection area B and an end area C allocated to the free end, the middle zone 5 has a slot 10 extending in the direction of extension E, an impression 12 and/or a curvature 11, wherein it is provided in particular that the impression 12 has rounded outer edges, is allocated to the inner surface 9 and/or lies opposite the curvature 11.

An electric press-in contact element, characterized in that the outline contour line 2' of the press-in section 2 runs along lines bent away from each other in connection area B and/or in contact area A.

An electric press-in contact element, characterized in that one or several press-in sections 2 are integrally joined with the contact body 1, the contact body 1 and the at least one press-in section 2 consist of a uniform starting material, wherein the press-in contact element preferably is made out of a metallized, for example a silver-plated, gold-plated or pre-tin-plated strip, in particular a hot-dip pre-tin-plated strip, as the stamped and bent part, and has a reinforcing bead 13 in the root area 3.

An electric press-in contact element, characterized in that the material of the press-in contact element is a copper alloy.

An electric press-in contact element, characterized in that the contact body 1 has contact elements 14, which in particular form a socket contact, and that the contact body 1 is box-shaped or round, and clinched and/or laser-welded at separating points.

An electric press-in contact element, characterized in that the contact body 1 has a free section and a positioning stop 15 on either side.

An electric press-in contact element, characterized in that side walls of the contact body 1 have push-in shoulders 16.

An electric press-in contact element, characterized in that the contact elements 14 form inwardly bent contact lamellae, which are provided with radius-shaped contact points 14'.

An electric press-in contact element, characterized in that the contact element 14 is an insulation-displacement connection, that the contact element 14 is a foil connection, and/or that the contact element 14 is a crimped connection.

While specific embodiments of the invention have been shown and described in detail to illustrate the inventive principles, it will be understood that the invention may be embodied otherwise without departing from such principles.

We claim:

1. An electric press-in contact element, comprising: a contact body; and at least one press-in section, which has a length extending in a direction of extension from a root area connected with the contact body, up to a free end, and forms a connection area that adjoins the root area, a contact area adjoining the connection area, and an end area that extends from the contact area up to the free end, wherein a middle zone running in the direction of extension is flanked over its entire length and on either side by a respective edge zone that is bent away from the middle zone, wherein the edge zones form contact surfaces in the contact area that face away from each other, which after insertion of the press-in section into a press-in opening of a circuit board abut against a wall of the press-in opening, wherein the edge zones form webs bent away from the middle zone around respective bending lines running in the direction of the extension of the middle zone and over an entire length of the connection area, the contact area and the end area, so as to form a channel, whose floor is the middle zone, that extends over the entire length of the press-in section, wherein, in the contact area, the middle zone has a slot extending in the direction of extension, which slot divides the press-in section into to contact legs that are resiliently deformable toward each other.

2. The electric press-in contact element according to claim 1, wherein an outer surface of the press-in section has a rounded section that joins an outer surface section of the middle zone with a regionally flat running contact surface.

3. The electric press-in contact element according to claim 1, wherein the press-in section has an inner surface with a section allocated to the middle zone and sections running substantially perpendicularly thereto allocated to the edge zones, which are bent out of the extension plane of the middle zone with formation of bending lines.

4. The electric press-in contact element according to claim 1, wherein the press-in section has an outline contour line lying in an extension plane of the middle zone that runs along an arc in the connection area extending from a first narrow area up to the root area.

5. The electric press-in contact element according to claim 1, wherein the middle zone has an impression in the contact area.

6. The electric press-in contact element according to claim 1, wherein the middle zone has a curvature in the contact area.

7. The electric press-in contact element according to claim 3, wherein, in the contact area, the middle zone has a slot extending in the direction of extension, an impression and a curvature, wherein the impression has rounded outer edges, is allocated to the inner surface and lies opposite the curvature.

8. The electric press-in contact element according to claim 1, wherein the press-in section has an outline contour line that runs along lines bent away from each other in the connection area and/or in the contact area.

9. The electric press-in contact element according to claim 1, wherein the at least one press-in section is integrally joined with the contact body, the contact body and the at least one press-in section consist of a uniform starting material.

10. The electric press-in contact element according to claim 9, wherein the press-in contact element is made out of a metallized strip as a stamped and bent part, and has a reinforcing bead in the root area.

11. The electric press-in contact element according to claim 10, wherein the strip is silver-plated, gold-plated or pre-tin-plated.

12. The electric press-in contact element according to claim 11, wherein the strip is hot-dip pre-tin-plated.

13. The electric press-in contact element according to claim 9, wherein the starting material of the press-in contact element is a copper alloy.

14. The electric press-in contact element according to claim 1, wherein the contact body has contact elements that form a socket contact, and the contact body is box-shaped or round, and clinched and/or laser-welded at separating points.

15. The electric press-in contact element according to claim 1, wherein the contact body has a free section and a positioning stop on either side.

16. The electric press-in contact element according to claim 1, wherein side walls of the contact body have push-in shoulders.

17. The electric press-in contact element according to claim 14, wherein the contact elements form inwardly bent contact lamellae, which are provided with radius-shaped contact points.

18. The electric press-in contact element according to claim 14, wherein the contact element is an insulation-displacement connection, the contact element is a foil connection, and/or the contact element is a crimped connection.

* * * * *